US005952928A

United States Patent [19]

Washington et al.

[11] Patent Number: 5,952,928

[45] Date of Patent: Sep. 14, 1999

[54] DRIVER ALERTNESS MAINTAINING DEVICE

[76] Inventors: Freddie L. Washington; Dian G. Washington, both of 6913 Greenway Dr., N. Mobile, Ala. 36608

[21] Appl. No.: 08/896,877

[22] Filed: Jul. 18, 1997

[51] Int. Cl.[6] ..... G08B 23/00

[52] U.S. Cl. ..... 340/575; 340/309.3; 340/309.4; 340/576; 340/691.5; 340/693.5; 368/63; 368/73; 368/98

[58] Field of Search ..... 368/63, 72, 73, 368/98; 340/309.15, 309.3, 309.4, 309.5, 439, 457, 573.1, 575, 576, 691.5, 693.5

[56] References Cited

U.S. PATENT DOCUMENTS

| | | | |
|---|---|---|---|
| 3,964,045 | 6/1976 | Conley | 340/279 |
| 4,196,412 | 4/1980 | Sluis et al. | 340/575 |
| 4,203,098 | 5/1980 | Muncheryan | 340/575 |
| 4,219,800 | 8/1980 | LeViness | 340/520 |
| 4,361,834 | 11/1982 | King | 340/575 |
| 4,839,749 | 6/1989 | Franklin | 340/457 |
| 4,987,403 | 1/1991 | Apfel | 340/457 |
| 5,555,536 | 9/1996 | Rolf et al. | 340/307.15 |
| 5,559,495 | 9/1996 | Cochran | 340/457 |
| 5,684,462 | 11/1997 | Gold | 340/576 |
| 5,714,925 | 2/1998 | Lee et al. | 340/575 |

*Primary Examiner*—Daniel J. Wu
*Attorney, Agent, or Firm*—Joseph N. Breaux

[57] ABSTRACT

A driver alertness maintaining device that includes timer/output mechanism circuitry that is programmable by the user to select and repeatedly output an audible alerting message through a speaker at a user selected interval; the driver alertness maintaining device further including a device housing including a circuitry compartment for containing the timer/output mechanism circuitry; a time display unit responsive to a display output signal from the timer/output mechanism circuitry; a visual alarm LED responsive to a visual output signal from the timer/output mechanism circuitry; a speaker responsive to an analog audio signal generated by a digital-to-analog converter circuit forming a portion of the timer/output mechanism circuitry, a speaker cover provided on the exterior of the device housing, an on/off switch in controlling connection with the timer/output mechanism circuitry, an interval set switch in controlling connection with the timer/output mechanism circuitry, a time set switch in controlling connection with the timer/output mechanism circuitry, and a message select switch in controlling connection with the timer/output mechanism circuitry.

1 Claim, 2 Drawing Sheets

DRIVER ALERTNESS MAINTAINING DEVICE

TECHNICAL FIELD

The present invention relates to vehicle safety devices and more particularly to a driver alertness maintaining device for use in vehicles that includes timer/output mechanism circuitry that is programmable by the user to select and repeatedly output an audible alerting message through a speaker and a visual alerting message through a light emitting device at a user selected interval; the driver alertness maintaining device including a device housing including a circuitry compartment for containing the timer/output mechanism circuitry; a time display unit responsive to a display output signal from the timer/output mechanism circuitry; a visual alarm LED responsive to a visual output signal from the timer/output mechanism circuitry; a speaker responsive to an analog audio signal generated by a digital-to-analog converter circuit forming a portion of the timer/output mechanism circuitry, a speaker cover provided on the exterior of the device housing, an on/off switch in controlling connection with the timer/output mechanism circuitry, an interval set switch in controlling connection with the timer/output mechanism circuitry, a time set switch in controlling connection with the timer/output mechanism circuitry, and a message select switch in controlling connection with the timer/output mechanism circuitry.

BACKGROUND OF THE INVENTION

Each year many accidents are caused by drivers who have fallen asleep behind the wheel of a vehicle. It would be a benefit, therefore, to have a device that could be installed within the passenger compartment of a vehicle and that would provide an audible output to maintain the alertness of the driver. Because different drivers can respond better to different stimuli, it would be a benefit to have a device for maintaining the alertness of a driver that could be installed within the passenger compartment of a vehicle and that allowed a user to select from a number of audible output messages for maintaining the alertness of the driver. It would be a further benefit to have such a driver alertness maintaining device that allowed a user to set the message repeating frequency of the audible output to a desired interval that was sufficient to maintain the alertness of the driver. In addition, it would be a further benefit to have a driver alertness maintaining device that included a visual alerting mechanism as well as an audible output to maintain the alertness of the driver. To increase the impact of the driver alertness maintaining device it would be desirable to have visual and audible alerting mechanisms that were initiated simultaneously and at user selected intervals.

SUMMARY OF THE INVENTION

It is thus an object of the invention to provide a driver alertness maintaining device.

It is a further object of the invention to provide a driver alertness maintaining device that is installable within the passenger compartment of a vehicle and that provides an audible output to maintain the alertness of the driver.

It is a still further object of the invention to provide a driver alertness maintaining device that is installable within the passenger compartment of a vehicle and that includes a message select mechanism for allowing a user to select from a number of audible output messages.

It is a still further object of the invention to provide a driver alertness maintaining device that included a mechanism for allowing a user to set an audible message repeating frequency.

It is a still further object of the invention to provide a driver alertness maintaining device that includes a visual alerting mechanism and an audible output.

It is a still further object of the invention to provide a driver alertness maintaining device that includes visual and audible alerting mechanisms that are initiated simultaneously and at user selected intervals.

It is a still further object of the invention to provide a driver alertness maintaining device that includes timer/output mechanism circuitry that is programmable by the user to select and repeatedly output an audible alerting message through a speaker and a visual alerting message through a light emitting device at a user selected interval; the driver alertness maintaining device including a device housing including a circuitry compartment for containing the timer/output mechanism circuitry; a time display unit responsive to a display output signal from the timer/output mechanism circuitry; a visual alarm LED responsive to a visual output signal from the timer/output mechanism circuitry; a speaker responsive to an analog audio signal generated by a digital-to-analog converter circuit forming a portion of the timer/output mechanism circuitry, a speaker cover provided on the exterior of the device housing, an on/off switch in controlling connection with the timer/output mechanism circuitry, an interval set switch in controlling connection with the timer/output mechanism circuitry, a time set switch in controlling connection with the timer/output mechanism circuitry, and a message select switch in controlling connection with the timer/output mechanism circuitry.

It is a still further object of the invention to provide a driver alertness maintaining device that accomplishes some or all of the above objects in combination.

Accordingly, a driver alertness maintaining device is provided. The driver alertness maintaining device includes timer/output mechanism circuitry that is programmable by the user to select and repeatedly output an audible alerting message through a speaker at a user selected interval; the driver alertness maintaining device including a device housing including a circuitry compartment for containing the timer/output mechanism circuitry; a time display unit responsive to a display output signal from the timer/output mechanism circuitry; a visual alarm LED responsive to a visual output signal from the timer/output mechanism circuitry; a speaker responsive to an analog audio signal generated by a digital-to-analog converter circuit forming a portion of the timer/output mechanism circuitry, a speaker cover provided on the exterior of the device housing, an on/off switch in controlling connection with the timer/output mechanism circuitry, an interval set switch in controlling connection with the timer/output mechanism circuitry, a time set switch in controlling connection with the timer/output mechanism circuitry, and a message select switch in controlling connection with the timer/output mechanism circuitry. In a preferred embodiment, the driver alertness maintaining device includes a visual alerting message that is output through a light emitting device and initiated by the timer/output mechanism circuitry.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
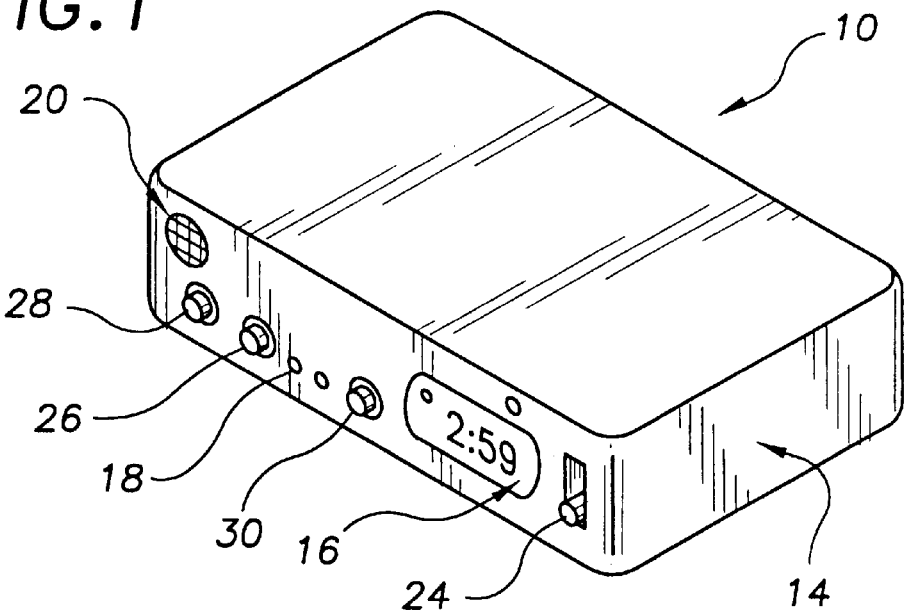
FIG. 1 is a perspective view of an exemplary embodiment of the driver alertness maintaining device of the present invention showing an exemplary device housing, the time display unit, the visual alarm LED, the speaker cover, the on/off switch, the interval set switch, the time set switch, and the message select switch.

FIG. 1 shows an exemplary embodiment of the driver alertness maintaining device of the present invention generally designated by the numeral 10. In this embodiment, driver alertness maintaining device 10 includes a timer/output mechanism circuitry board, generally designated 12 (FIG. 3); a device housing, generally designated 14; a time display unit 16; a visual alarm LED 18, a speaker cover 20, a speaker 22 (FIG. 4); an on/off switch 24, an interval set switch 26, a time set switch 28, and a message select switch 30. In this embodiment device housing 14 is molded from plastic.

Figure 2:
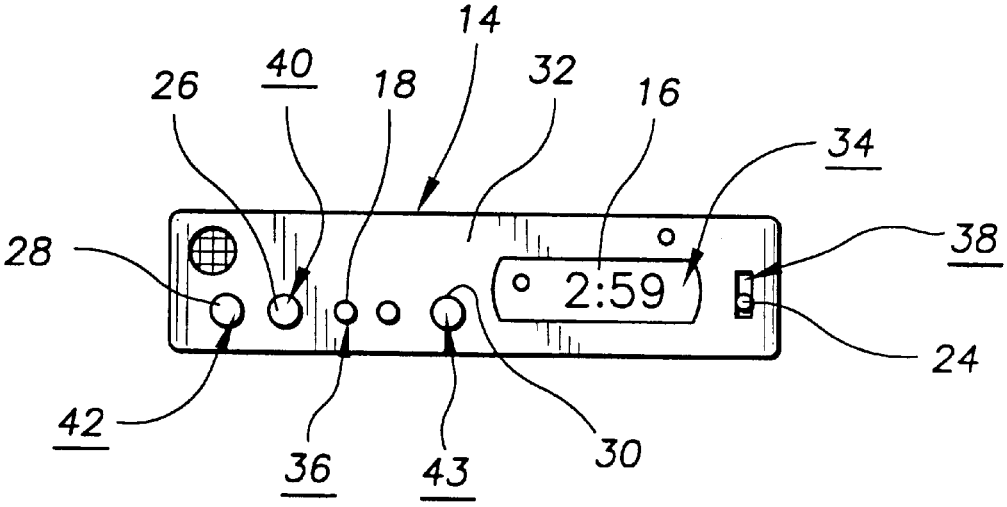
FIG. 2 is a front plan view of the driver alertness maintaining device of FIG. 1 the front face of the device housing, the time display window, the speaker cover, the on/off switch, the interval set switch, the time set switch, and the message select switch.

With reference to FIG. 2 device housing 14 includes a front panel 32 having a time display unit opening 34; a visual alarm LED aperture 36, an on/off switch opening 38, an interval set switch aperture 40, a time set switch aperture 42, and a message select switch aperture 43 formed therethrough. Time display unit 16 is a conventional liquid crystal display. Visual alarm LED 18 is a conventional light emitting diode. Speaker 22 (FIG. 4) is a conventional audio speaker. On/off switch 24 is a convention two-position electrical switch. Interval set switch 26, time set switch 28, and message select switch 30 are all momentary contact switches.

Figure 3:
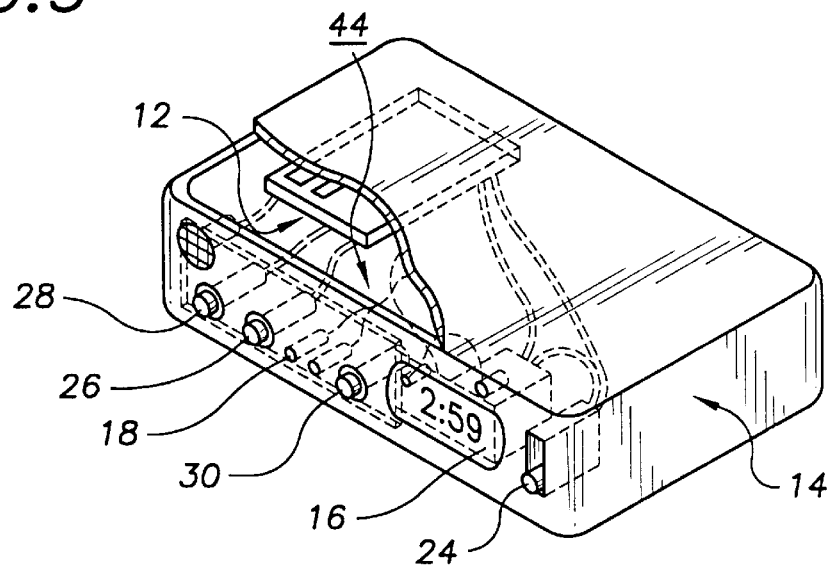
FIG. 3 is a partial cut-away perspective view of view of the driver alertness maintaining device of FIG. 1 showing the timer/output mechanism circuitry board positioned within the circuitry compartment of the device housing.

Referring to FIG. 3, a circuitry compartment 44 is provided within device housing 14 for containing timer/output mechanism circuitry board 12 and the associated connecting wiring to time display unit 16, visual alarm LED 18, speaker 22 (FIG. 4), on/off switch 24, interval set switch 26, time set switch 28, and message select switch 30.

Figure 4:
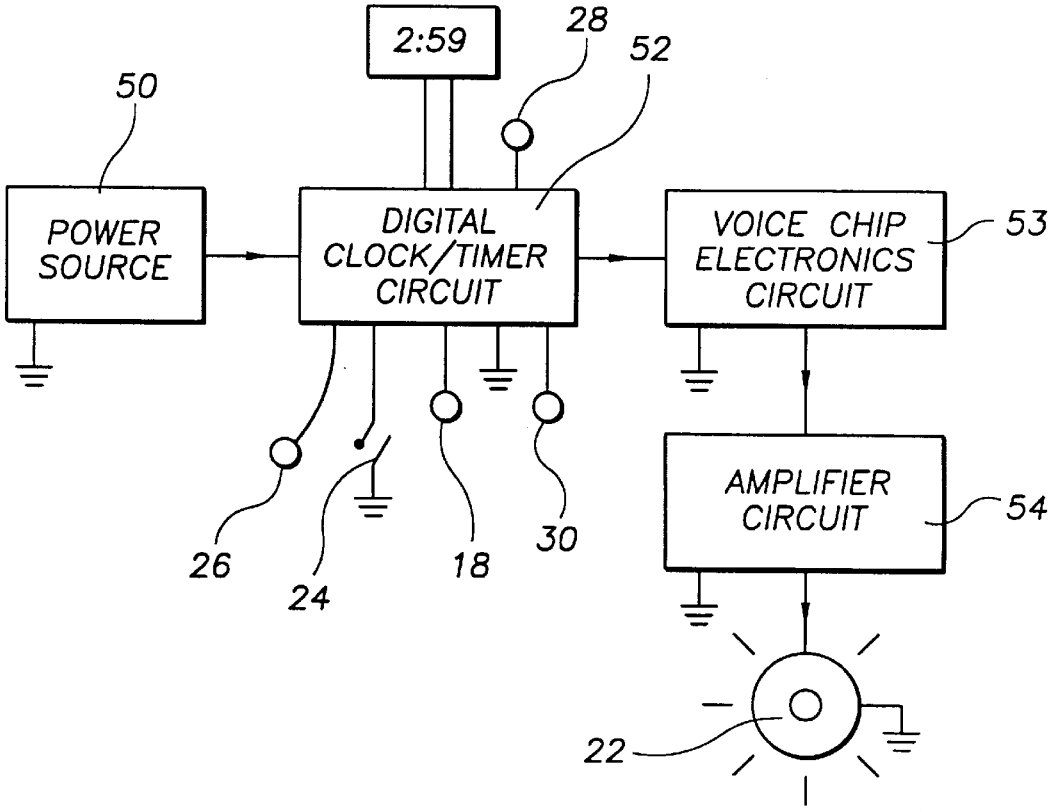
FIG. 4 is a schematic diagram of the timer/output mechanism circuitry board showing the digital clock/timer circuit, the visual alarm LED, the on/off switch, the interval set switch, the time set switch, the message select switch, the power supply circuit, the digital-to-analog converter chip, the audio output amplifier, the speaker.

With reference now to FIG. 4, timer/output mechanism circuitry board 12 (FIG. 4) includes a conventional power source 50, a conventional digital clock/timer circuit 52, visual alarm LED 18, on/off switch 24, interval set switch 26, time set switch 28, and message select switch 30, a conventional digital-to-analog voice chip converter circuit 53, a conventional audio output amplifier 54, and speaker 22. In use, the user selects the desired message, programs the correct time and the desired time interval between message outputs. Each time the audio message and visual output are activated together the driver is reminded to focus his/her attention on the driving task. Activating the audio message and the visual output together increases the likely hood of attracting the driver's attention.

It can be seen from the preceding description that a driver alertness maintaining device has been provided that is installable within the passenger compartment of a vehicle; that provides an audible output to maintain the alertness of the driver; that includes a message select mechanism for allowing a user to select from a number of audible output messages; that includes an interval select mechanism for allowing a user to set an audible message repeating frequency; that includes a visual alerting mechanism and an audible output; that includes visual and audible alerting mechanisms that are initiated simultaneously and at user selected intervals; and that includes timer/output mechanism circuitry that is programmable by the user to select and repeatedly output an audible alerting message through a speaker and a visual alerting message through a light emitting device at a user selected interval; the driver alertness maintaining device including a device housing including a circuitry compartment for containing the timer/output mechanism circuitry; a time display unit responsive to a display output signal from the timer/output mechanism circuitry; a visual alarm LED responsive to a visual output signal from the timer/output mechanism circuitry; a speaker responsive to an analog audio signal generated by a digital-to-analog converter circuit forming a portion of the timer/output mechanism circuitry, a speaker cover provided on the exterior of the device housing, an on/off switch in controlling connection with the timer/output mechanism circuitry, an interval set switch in controlling connection with the timer/output mechanism circuitry, a time set switch in controlling connection with the timer/output mechanism circuitry, and a message select switch in controlling connection with the timer/output mechanism circuitry.

It is noted that the embodiment of the driver alertness maintaining device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A method of maintaining driver alertness comprising the steps of:

a) providing a driver alertness maintaining device comprising:

timer/output mechanism circuitry including a digital-to-analog converter circuit;

a device housing including a circuitry compartment for containing said timer/output mechanism circuitry;

a time display unit responsive to a display output signal from said timer/output mechanism circuitry for visually displaying numeric time information characters;

an audio speaker that is responsive to an analog audio signal generated by said digital-to-analog converter circuit forming a portion of said timer/output mechanism circuitry;

a speaker cover provided on said exterior of said device housing;

an on/off switch in controlling connection with said timer/output mechanism circuitry;

an interval set switch in controlling connection with said timer/output mechanism circuitry, a time set switch in controlling connection with said timer/output mechanism circuitry; said timer/output mechanism circuitry repeatedly outputting one of a plurality of predetermined audible alerting messages that are each stored as a digital code within said timer/output mechanism circuitry through said audio speaker at a user selected interval;

a visual alarm light emitting device that is responsive to a visual output signal from said timer/output mechanism circuitry; said timer/output mechanism circuitry outputting said audible alerting message and activating said visual alarm light emitting device simultaneously; and a message select switch in controlling connection with said timer/output mechanism circuitry, said message select switch providing an input modality for allowing a user to select one of said plurality of predetermined audible alerting messages for output on said audio speaker;

b) selecting one of said plurality of predetermined audible alerting messages using said message select switch;

c) programming the desired time interval between message outputs using said interval set switch; and d) driving a vehicle after steps a,b and c are accomplished.

* * * * *